US012686952B2

(12) United States Patent
Hwang

(10) Patent No.: US 12,686,952 B2
(45) Date of Patent: Jul. 21, 2026

(54) ELECTROSPINNING ALIGNMENT APPARATUS

(71) Applicant: IDKLAB INC., Daejeon (KR)

(72) Inventor: Wontae Hwang, Daejeon (KR)

(73) Assignee: IDKLAB INC., Daejeon (KR)

( * ) Notice: Subject to any disclaimer, the term of this patent is extended or adjusted under 35 U.S.C. 154(b) by 574 days.

(21) Appl. No.: 17/915,577

(22) PCT Filed: Mar. 23, 2021

(86) PCT No.: PCT/KR2021/003547

§ 371 (c)(1),
(2) Date: Sep. 29, 2022

(87) PCT Pub. No.: WO2021/201482

PCT Pub. Date: Oct. 7, 2021

(65) Prior Publication Data

US 2023/0160106 A1 May 25, 2023

(30) Foreign Application Priority Data

Mar. 30, 2020 (KR) ..... 10-2020-0038012

(51) Int. Cl.

| | |
|---|---|
| ***D01D 5/00*** | (2006.01) |
| ***D01D 5/18*** | (2006.01) |
| ***D04H 1/728*** | (2012.01) |
| ***D04H 1/74*** | (2006.01) |

(52) U.S. Cl.

CPC ..... *D01D 5/0069* (2013.01); *D01D 5/0084* (2013.01); *D04H 1/728* (2013.01); *D04H 1/74* (2013.01); *D01D 5/18* (2013.01); *D10B 2321/042* (2013.01); *D10B 2321/10* (2013.01); *D10B 2505/04* (2013.01)

(58) Field of Classification Search

CPC .. D01D 5/0061; D01D 5/0069; D01D 5/0084; D01D 5/0076; D04H 1/728; B01D 2239/025

See application file for complete search history.

(56) References Cited

U.S. PATENT DOCUMENTS

2008/0102145 A1* 5/2008 Kim ..... D01F 8/12 425/72.2
2008/0241297 A1* 10/2008 Park ..... B82Y 30/00 425/131.5
2009/0326128 A1 12/2009 Macossay-Torres
(Continued)

FOREIGN PATENT DOCUMENTS

KR 20110026185 A * 3/2011 ..... D01D 5/003
KR 1020120077437 A 7/2012
(Continued)

OTHER PUBLICATIONS

English Translation for KR-20110026185-A (Year: 2011).*
English Translation for Chang et al. (KR 10-2011-0026185) (Year: 2011).*

*Primary Examiner* — Seyed Masoud Malekzadeh
(74) *Attorney, Agent, or Firm* — CHRISTENSEN O'CONNOR JOHNSON KINDNESS PLLC

(57) ABSTRACT

Provided is an electrospinning alignment apparatus enabling mass production of nanofiber membranes by simultaneously nanofibers that are spun in alignment in one direction on a transferred carrier and nanofibers that are randomly spun.

15 Claims, 14 Drawing Sheets

(56) References Cited

U.S. PATENT DOCUMENTS

| | | | | |
|---|---|---|---|---|
| 2010/0317790 | A1 | 12/2010 | Jang et al. | |
| 2016/0289864 | A1* | 10/2016 | Park | B29C 48/92 |
| 2019/0338445 | A1* | 11/2019 | Haff | D01D 5/0092 |

FOREIGN PATENT DOCUMENTS

| | | | | | |
|---|---|---|---|---|---|
| KR | 1020160100522 | A | | 8/2016 | |
| KR | 101821049 | B1 | | 1/2018 | |
| KR | 1020200030798 | A | | 3/2020 | |
| WO | 20110026185 | A | * | 3/2011 | |
| WO | WO-2014171625 | A1 | * | 10/2014 | D01D 5/34 |

* cited by examiner

ELECTROSPINNING ALIGNMENT APPARATUS

TECHNICAL FIELD

The present disclosure relates to an electrospinning alignment apparatus.

BACKGROUND ART

Methods of manufacturing nanofibers include drawing, template synthesis, phase separation, self-assembly, electrospinning, and the like. Among these methods, electrospinning is generally used to continuously fabricate nanofibers.

Electrospinning is a method that applies high voltage between a nozzle for spinning a spinning solution and a stage where a substrate is placed to form a higher electric field than the surface tension of the spinning solution and spin the spinning solution into nanofibers. Nanofibers fabricated by electrospinning are affected by the physical properties of the spinning solution—such as viscosity, elasticity, conductivity, dielectric property, and surface tension—the intensity of the electric field, the distance between the nozzle and an integrated electrode, and so on.

In this instance, there is a conventional technique for aligning nanofibers in one direction by changing an electric field using an insulating block in an electrospinning process. In such a conventional technique, nanofiber membranes can be fabricated which are aligned in a grid by moving and rotating a lower substrate. These nanofiber membranes may be used in bio applications or in fine dust filters.

However, this conventional technique has limitations in the mass production of nanofiber membranes since the lower substrate is moved and/or rotated while an electrospinning solution is spun using a single nozzle.

DISCLOSURE

Technical Problem

The present disclosure is directed to providing an electrospinning alignment apparatus that enables mass production of nanofiber membranes by simultaneously spinning nanofibers that are spun in alignment in one direction on a transferred carrier and nanofibers that are randomly spun.

Technical Solution

An embodiment of the present disclosure provides an electrospinning alignment apparatus including: a plurality of first electrospinning portions to which a first voltage is applied, for aligning and spinning nanofibers in a first horizontal direction; a plurality of second electrospinning portions to which the first voltage is applied, for randomly spinning nanofibers; a stage portion to which a second voltage different than the first voltage is applied, spaced apart in a first vertical direction in which nanofibers are spun from the plurality of electrospinning portions and the plurality of second electrospinning portions; and a carrier transfer portion for coating the nanofibers spun from the plurality of first electrospinning portions and the plurality of second electrospinning portions onto the carrier by continuously passing the carrier between a position where the plurality of first electrospinning portions and the plurality of second electrospinning portions is disposed and a position where the stage portion is disposed.

According to one aspect, the plurality of first electrospinning portions may be spaced apart from each other in a second horizontal direction perpendicular to the first horizontal direction, and each of the plurality of first electrospinning portions may include: a first spinning nozzle for spinning nanofibers from a spinning solution; and a guide portion that generates a force exerted on the nanofibers spun from the first spinning nozzle in the first horizontal direction by changing an electric field formed between the first spinning nozzle and the stage portion so that nanofibers spun from the first spinning nozzle are aligned in the first horizontal direction.

According to another aspect, the guide portion may include a first guide body and a second guide body which are spaced apart from each other in the second horizontal direction perpendicular to the first horizontal direction, and the first spinning nozzle may be disposed under a space between the first guide body and the second guide body.

According to another aspect, at least one of the first and second guide bodies included in one of the plurality of first electrospinning portions may be shared with another one of the plurality of first electrospinning portions.

According to another aspect, the first guide body and the second guide body may be individually made of a material with a relative dielectric constant of 50 or lower.

According to another aspect, the plurality of second electrospinning portions may be spaced apart from each other in the second horizontal direction perpendicular to the first horizontal direction, and each of the plurality of second electrospinning portions may include a second spinning nozzle for spinning nanofibers from a spinning solution.

According to another aspect, the plurality of first electrospinning portions each may be disposed by forming m first columns (m is a natural number) including n first spinning nozzles (n is a natural number), and the plurality of second electrospinning portions each may be disposed by forming i second columns (i is a natural number) including j second spinning nozzles (j is a natural number), wherein the m first columns and the i second columns are arranged in an alternating manner.

According to another aspect, the n and the j may be determined based on the width of the carrier in the second horizontal direction perpendicular to the first horizontal direction.

According to another aspect, the production of nanofibers per unit of time may be adjusted by adjusting the m, the i, and the transfer rate of the carrier.

The thickness of nanofibers spun from the plurality of first electrospinning portions may be relatively larger than the thickness of nanofibers spun from the plurality of second electrospinning portions.

The size of a space between nanofibers coated onto the carrier may be adjusted by adjusting the difference between the thickness of nanofibers spun from the plurality of first electrospinning portions and the thickness of nanofibers spun form the plurality of second electrospinning portions.

According to another aspect, the first vertical direction in which nanofibers are spun may include an upward direction perpendicular to the first horizontal direction.

According to another aspect, the carrier transfer portion may transfer the carrier in a roll-to-roll manner while it is being unwound from a roll.

According to another aspect, the carrier may include a non-woven fabric.

According to another aspect, the nanofibers spun from the plurality of first electrospinning portions and the nanofibers spun from the plurality of second electrospinning portions may include polyacrylonitrile.

According to another aspect, the nanofibers spun from the plurality of first electrospinning portions and the nanofibers spun from the plurality of second electrospinning portions include one or a combination of two of the following: polyacrylonitrile, PVDF-HFP (polyvinylidene fluoride-hexafluoropropylene), polymethylmethacrylate (PMMA), polyurethane, polysulfones (polysulfone, polyethersulfone, and polyphenylene sulfone), polyvinyl acetate (PVAc), polyacrylic acid (PAA), polyvinyl alcohol (PVA), polyvinylidene fluoride (PVDF)), polyimide (PI), polystyrene (PS), polycaprolactone (PCL), polylactic acid (PLA), poly (lactic-co-glycolic acid) (PLGA), and chitosan.

According to another aspect, the diameter of the nanofibers spun from the first electrospinning portion ranges from 300 nm to 2,000 nm, and the diameter of the nanofibers spun from the second electrospinning portion ranges from 10 nm to 300 nm.

Advantageous Effects

Mass production of nanofiber membranes is enabled by nanofibers that are spun in alignment in one direction on a transferred carrier and nanofibers that are randomly spun.

DESCRIPTION OF DRAWINGS

The accompanying drawings included as part of the detailed description in order to help understanding of the present disclosure provide embodiments of the present disclosure, and describe the technical spirit of the present disclosure along with the detailed description.

BEST MODE

Since the present disclosure make various modifications and have several embodiments, particular embodiments will be described in detail below with reference to the accompanying drawings.

In describing the present disclosure, detailed descriptions of related well-known technologies will be omitted to avoid unnecessary obscuring the present disclosure.

It will be understood that, although the terms first, second, etc., may be used to describe various elements, these elements should not be limited by these terms. These terms are only used to distinguish one element from another element.

FIGS. 1 to 5 are views for explaining a concept of electrospinning of an electrospinning alignment apparatus according to one embodiment of the present disclosure.

Figure 1:
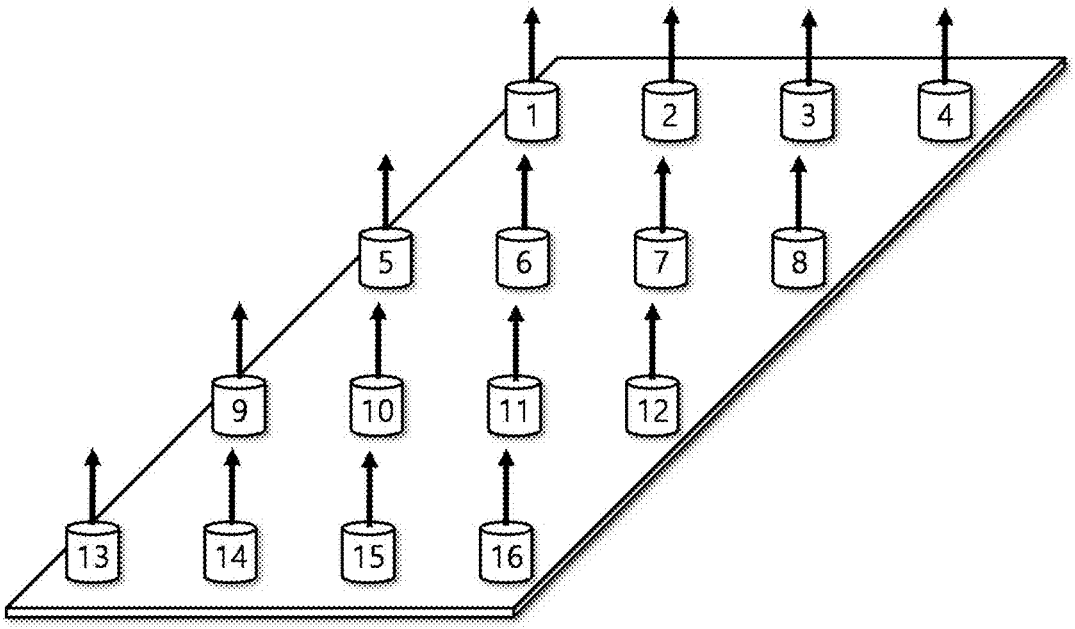
FIGS. 1 to 5 are views for explaining a concept of electrospinning of an electrospinning alignment apparatus according to one embodiment of the present disclosure.

First, FIG. 1 schematically shows a plurality of spinning nozzles 1 to 16 for spinning nanofibers from a spinning solution. Arrows respectively corresponding to the plurality of spinning nozzles 1 to 16 indicate respective directions in which the plurality of spinning nozzles 1 to 16 spin nanofibers. Although FIG. 1 shows an example in which the plurality of spinning nozzles 1 to 16 form four columns and four rows and spin nanofibers upward, the number of spinning nozzles, the number of columns, the number of rows, the direction in which nanofibers are spun, and so on may be variously adjusted as explained later.

Figure 2:
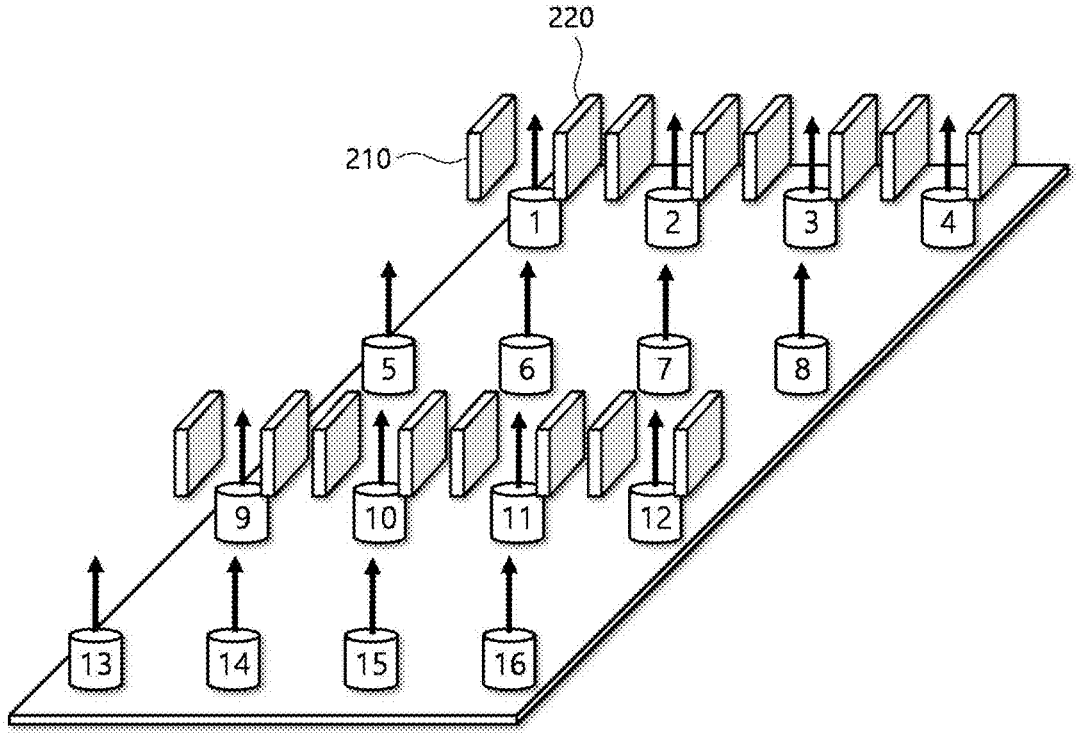

FIG. 2 shows an example in which guide portions are formed at spinning nozzles 1 to 4 in a first row and spinning nozzles 9 to 12 in a third row. For example, a first guide body 210 and a second guide body 220 may be formed over the spinning nozzle 1 in the first row and the first column, spaced apart from each other. In this instance, the first guide body 210 and the second guide body 220 may be disposed in such a way that nanofibers spun from the spinning nozzle 1 in the first row and the first column pass between the first guide body 210 and the second guide body 220 along a direction in which the spinning nozzles 1 to 4 in the first row are spaced out. The first guide body 210 and the second guide body 220 may be individually made of a material with a relative dielectric constant of 50 or lower. In other words, the guides portions that are formed at the spinning nozzles 1 to 4 in the first row and the spinning nozzles 9 to 12 in the third row may exert force in a certain direction on nanofibers spun from the spinning nozzles 1 to 4 in the first row and the spinning nozzles 9 to 12 in the third row by changing an electric field formed between the spinning nozzles and a stage portion to be described later. For example, a force may be exerted on the nanofibers spun from the spinning nozzle 1 in the first row and the first column in a direction (hereinafter, "first horizontal direction") perpendicular to the direction in which the first guide body 210 and the second guide body 220 are aligned.

Figure 3:
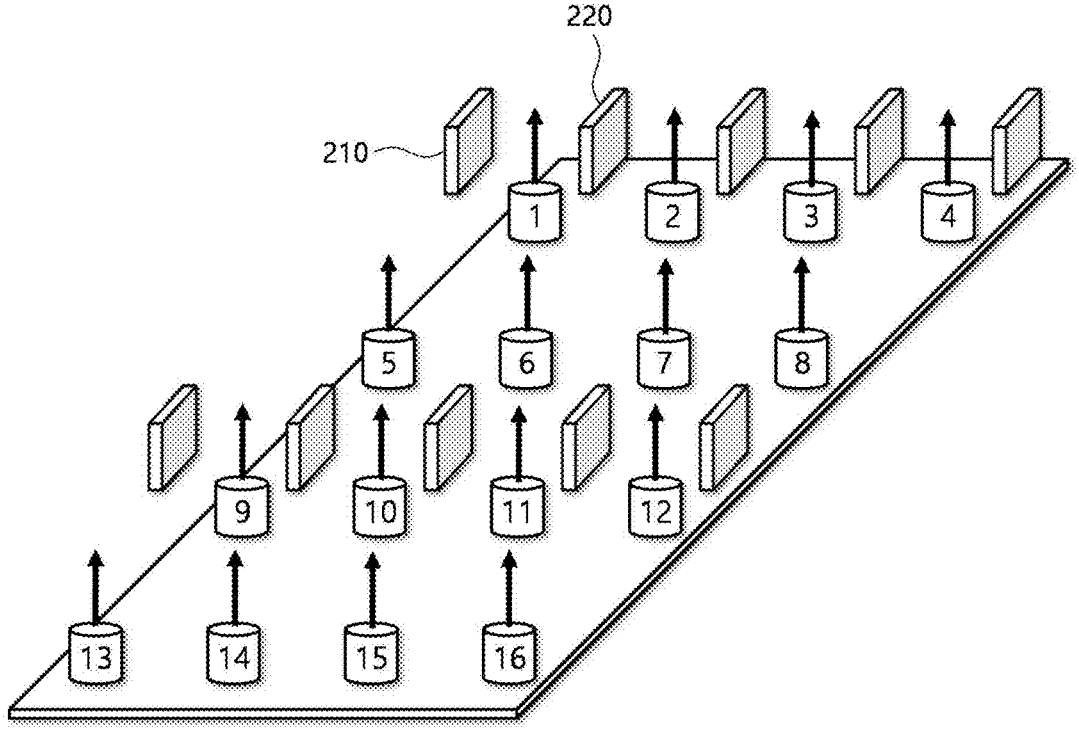

In some embodiments, guide bodies included in a guide portion may be shared between neighboring spinning nozzles. FIG. 3 shows an example in which guide bodies are shared between neighboring spinning nozzles. More specifically, the second guide body 220, between the first guide body 210 and second guide body 220 for the spinning nozzle 1 in the first row and the first column, may be shared with the spinning nozzle 2 in the first row and the second column.

In this instance, as in FIGS. 2 and 3, nanofibers spun from the spinning nozzles 1 to 4 in the first row and the spinning nozzles 9 to 12 in the third row may be aligned in the first horizontal direction by guide portions, and nanofibers spun from the spinning nozzles 5 to 8 in the second row and the spinning nozzles 13 to 16 in the fourth row may be randomly spun.

Figure 4:
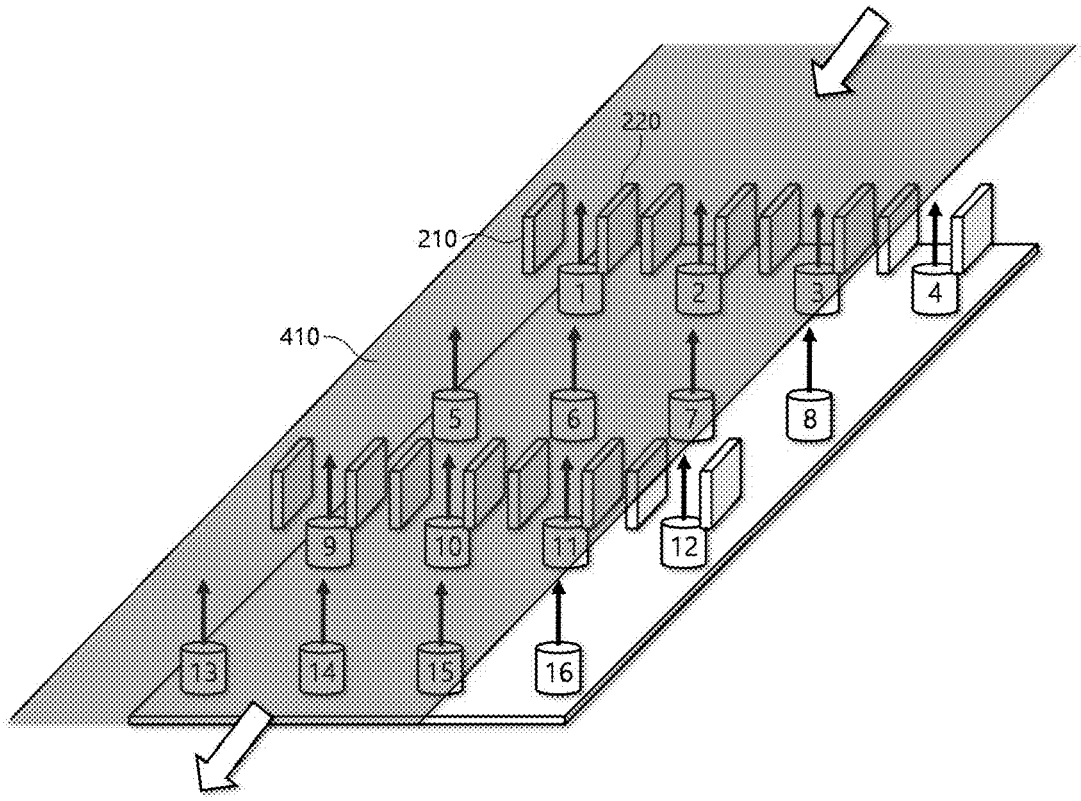

FIG. 4 shows that a carrier 410 is transferred in the first horizontal direction, over the plurality of spinning nozzles 1 to 16 explained with reference to FIG. 2. In this instance, the nanofibers spun from the spinning nozzles 1 to 4 in the first row and the spinning nozzles 9 to 12 in the third row may be coated on the carrier 410 in the first horizontal direction, and the nanofibers spun from the spinning nozzles 5 to 8 in the second row and the spinning nozzles 13 to 16 in the fourth row may be randomly coated on the carrier 410.

Figure 5:
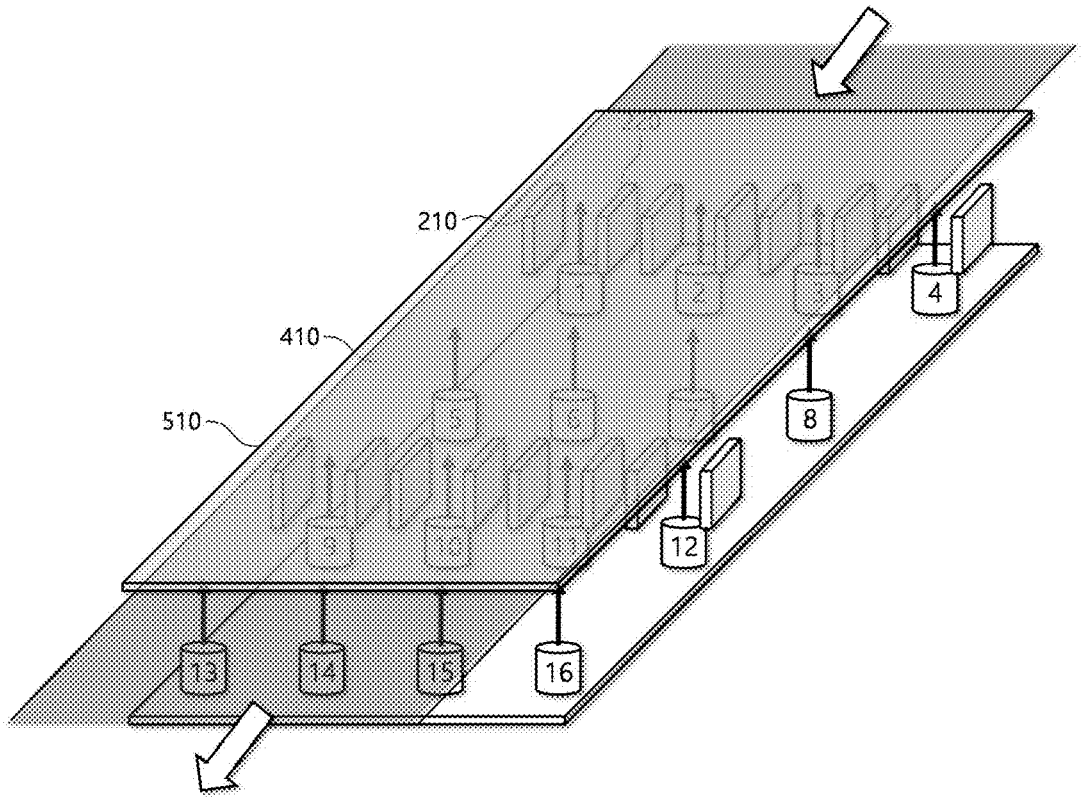

Meanwhile, although omitted in FIGS. 1 to 4, a stage portion 510 may be formed over the plurality of spinning nozzles 1 to 16, as shown in FIG. 5, in order to have electrospinning done. For example, a first voltage may be applied to the plurality of spinning nozzles 1 to 16, and a second voltage different than the first voltage may be applied to the stage portion 510. By the application of the first voltage and the second voltage, a spinning solution injected into the plurality of spinning nozzles 1 to 16 may be electrically spun, and an electric field may be formed between the plurality of spinning nozzles 1 to 16 and the stage portion 510. In this instance, the guide portions may change this electric field so that a first horizontal force is exerted on the nanofibers.

Figure 6:
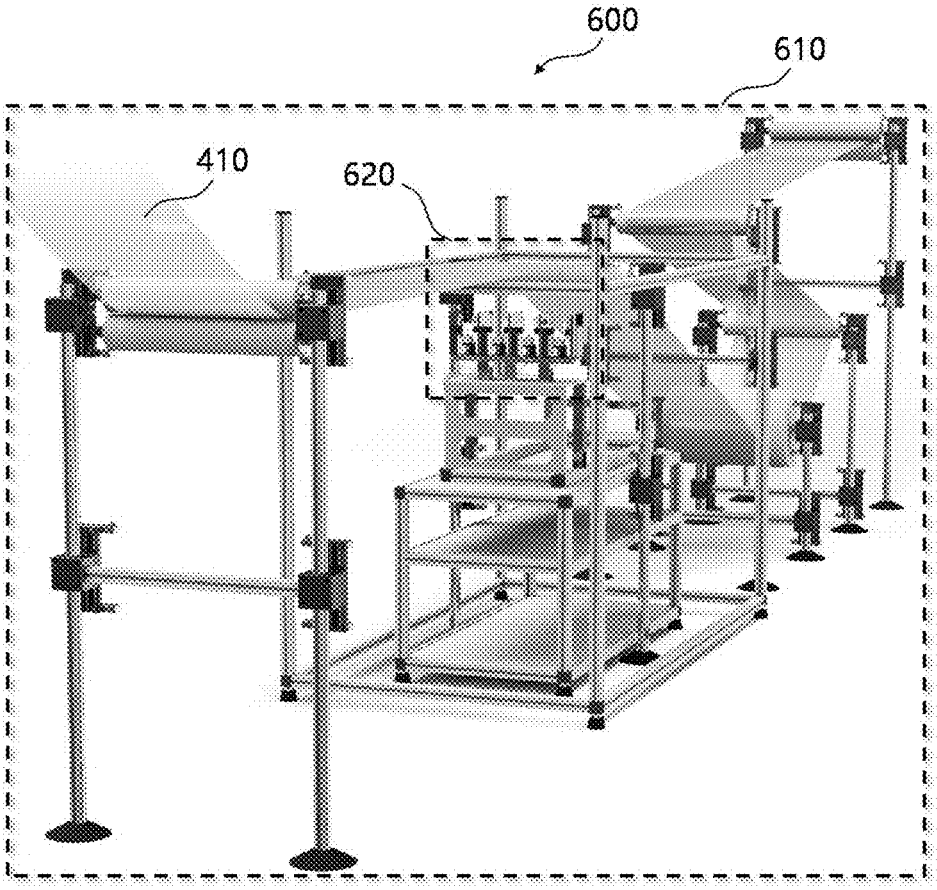
FIGS. 6 and 7 are views illustrating an example of an electrospinning alignment apparatus according to one embodiment of the present disclosure.
Figure 7:
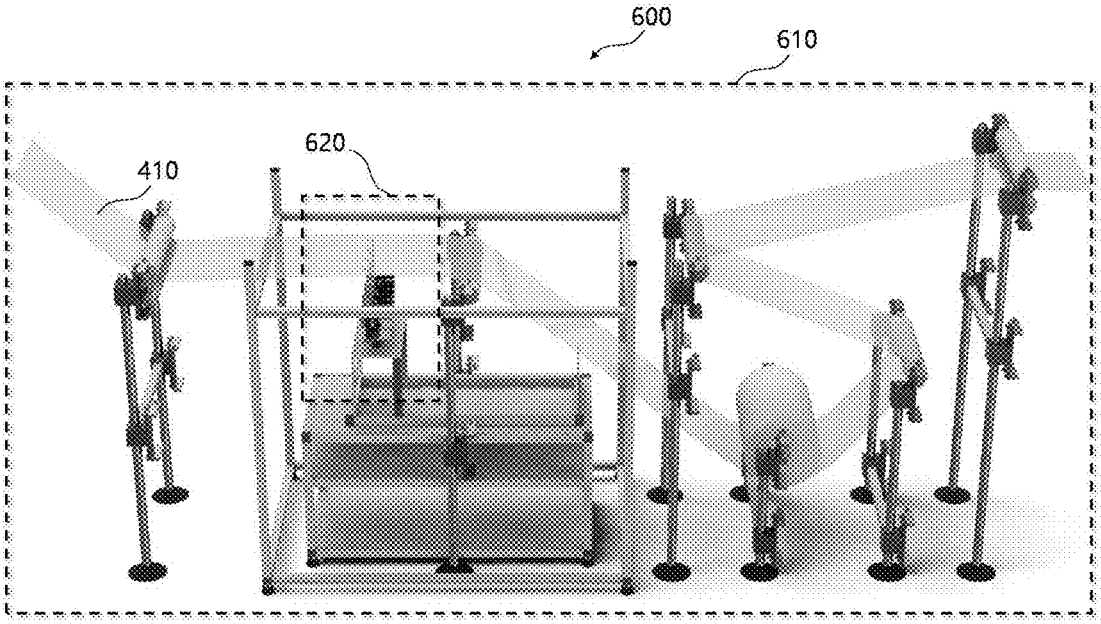

FIGS. 6 and 7 are views illustrating an example of an electrospinning alignment apparatus according to one embodiment of the present disclosure. The electrospinning alignment apparatus 600 according to this embodiment may include a carrier transfer portion for transferring a carrier 410, as shown in a first dotted box 610, and may include an electrospinning portion for fabricating nanofiber membranes by spinning nanofibers to the carrier 410 being transferred so as to coat nanofibers onto an underside of the carrier 410, as shown in a second dotted box 620. In the embodiment of FIGS. 6 and 7, only one column of spinning nozzles is shown, but, as explained previously with reference to FIGS. 1 to 5, the electrospinning portion may virtually include a plurality of spinning nozzles 1 to 16 and guide portions and a stage portion 510 that are applied to at least some (e.g., the spinning nozzles 1 to 4 in the first row and the spinning nozzles 9 to 12 in the third row) of the plurality of spinning nozzles 1 to 16. In this instance, the carrier transfer portion may be implemented to transfer the carrier 410 in a roll-to-roll manner while it is being unwound from a roll, whereupon the carrier 410 may pass between the plurality of spinning nozzles 1 to 16 and the stage portion 510.

In more general terms, an electrospinning alignment apparatus according to an embodiment may include a plurality of first electrospinning portions to which a first voltage is applied, for aligning and spinning nanofibers in a first horizontal direction, a plurality of second electrospinning portions to which the first voltage is applied, for randomly spinning nanofibers, a stage portion to which a second voltage different than the first voltage is applied, spaced apart in a first vertical direction in which nanofibers are spun from the plurality of electrospinning portions and the plurality of second electrospinning portions, and a carrier transfer portion for coating the nanofibers spun from the plurality of first electrospinning portions and the plurality of second electrospinning portions onto the carrier by continuously passing the carrier between a position where the plurality of first electrospinning portions and the plurality of second electrospinning portions is disposed and a position where the stage portion is disposed.

In this instance, the plurality of first electrospinning portions may be spaced apart from each other in a second horizontal direction perpendicular to the first horizontal direction, and each of the plurality of first electrospinning portions may include a first spinning nozzle for spinning nanofibers from a spinning solution and a guide portion that generates a force exerted on the nanofibers spun from the first spinning nozzle in the first horizontal direction by changing an electric field formed between the first spinning nozzle and the stage portion so that nanofibers spun from the first spinning nozzle are aligned in the first horizontal direction. For example, the plurality of first electrospinning portions may correspond to the spinning nozzles 1 to 4 in the first row and the spinning nozzles 9 to 12 in the third row to which the guide portion is applied.

Meanwhile, the guide portion may include a first guide body and a second guide body which are spaced apart from each other in the second horizontal direction perpendicular to the first horizontal direction, and the first spinning nozzle may be disposed under a space between the first guide body and the second guide body. For example, as described previously, the spinning nozzle 1 in the first row and the first column may be disposed under a space between the first guide body 210 and the second guide body 220.

Moreover, at least one of the first and second guide bodies included in one of the plurality of first electrospinning portions may be shared with another one of the plurality of first electrospinning portions. As described previously, FIG. 3 illustrates an example in which the spinning nozzle 1 in the first row and the first column and the spinning nozzle 2 in the first row and the second column share the second guide body 220.

In addition, as already described earlier, the first guide body and the second guide body may be individually made of a material with a relative dielectric constant of 50 or lower.

Furthermore, the plurality of second electrospinning portions may be spaced apart from each other in the second horizontal direction perpendicular to the first horizontal direction, and each of the plurality of second electrospinning portions may include a second spinning nozzle for spinning nanofibers from a spinning solution. For example, the plurality of second electrospinning portions may correspond to the spinning nozzles 5 to 8 in the second row and the spinning nozzles 13 to 16 in the fourth row to which the guide portion is not applied.

Such a plurality of first and second electrospinning portions will be described in more general terms. The plurality of first electrospinning portions each may be disposed by forming m first columns (m is a natural number) including n first spinning nozzles (n is a natural number), and the plurality of second electrospinning portions each may be disposed by forming i second columns (i is a natural number) including j second spinning nozzles (j is a natural number). The m first columns and the i second columns may be arranged in an alternating manner.

Here, the n and the j may be determined based on the width of the carrier in the second horizontal direction perpendicular to the first horizontal direction. In other words, the number of spinning nozzles included in one column may be determined based on the width of the carrier.

Moreover, the production of nanofibers per unit of time may be adjusted by adjusting the m, the i, and the transfer rate of the carrier. For example, increases in m and n may mean an increase in the surface area of nanofibers spun at a time. Accordingly, increasing the transfer rate of the carrier may increase the surface area of nanofibers simultaneously coated onto the carrier, thereby increasing the production of nanofibers per unit of time.

Meanwhile, nanofibers may be spun in such a way that the thickness of nanofibers spun from the plurality of first electrospinning portions is relatively larger than the thickness of nanofibers spun from the plurality of second electrospinning portions. For example, the size of a space between nanofibers coated onto the carrier may be adjusted by adjusting the difference between the thickness of nanofibers spun from the plurality of first electrospinning portions and the thickness of nanofibers spun form the plurality of second electrospinning portions.

Figure 8:
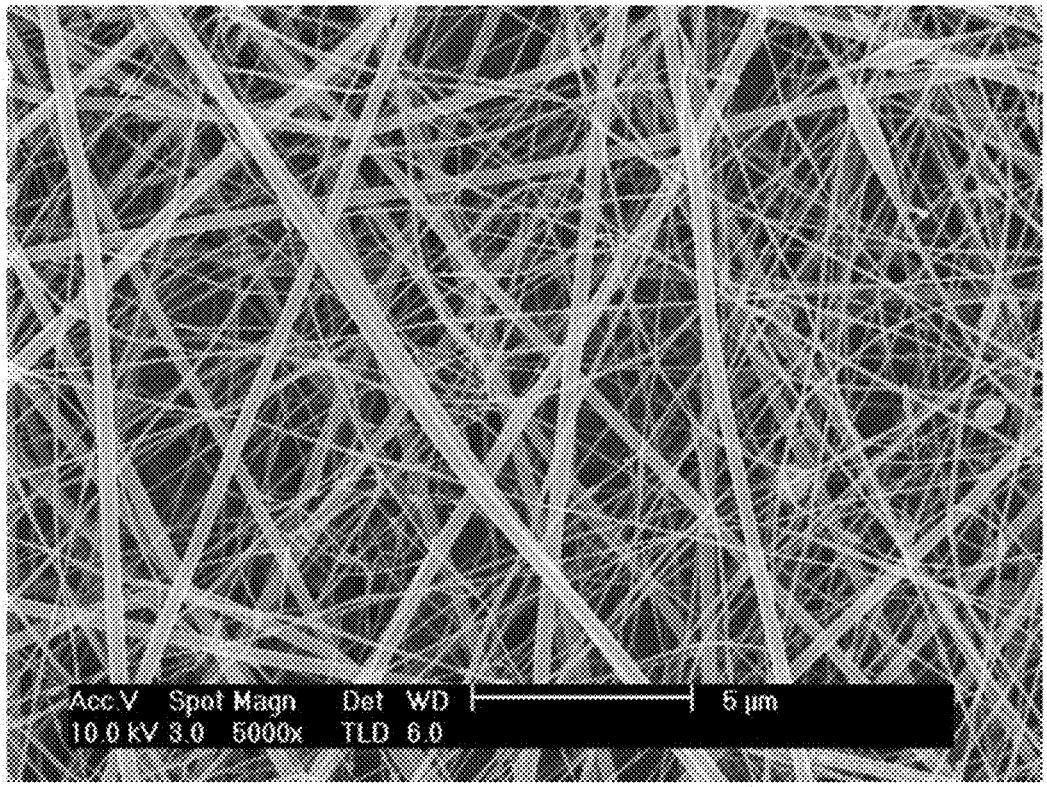
FIGS. 8 and 9 are scanning electron microscope (SEM) photographs of nanofibers fabricated by an electrospinning alignment apparatus according to one embodiment of the present disclosure.
Figure 9:
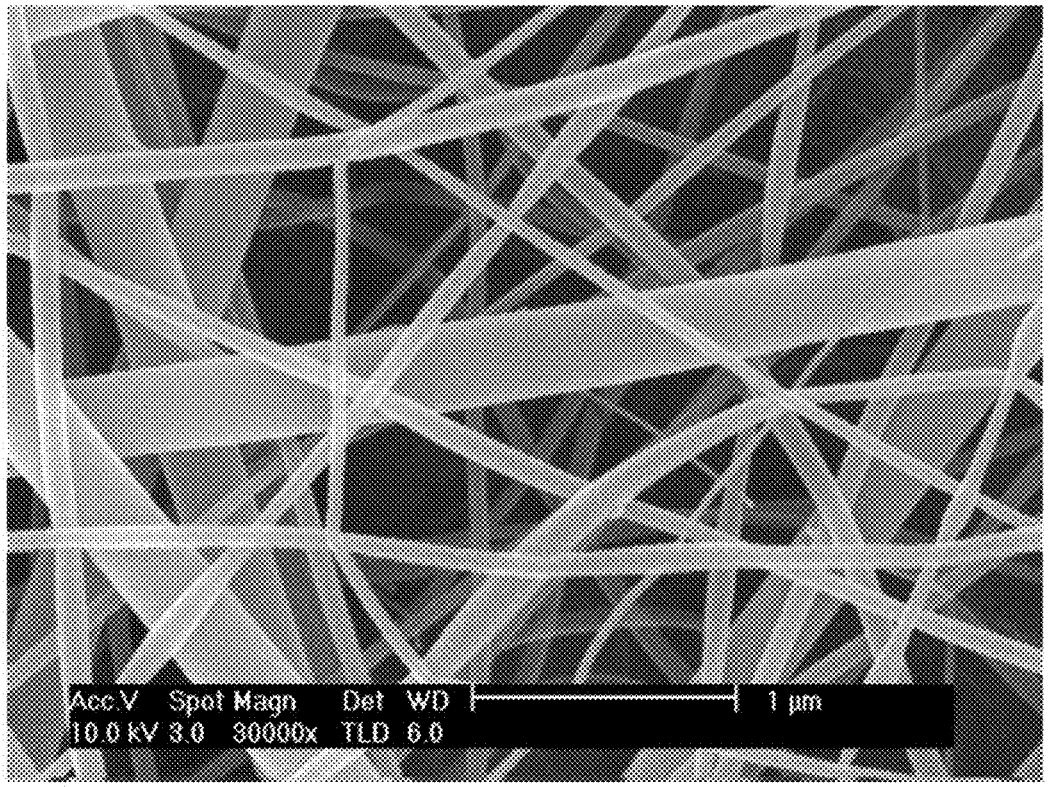

FIGS. 8 and 9 are scanning electron microscope (SEM) photographs of nanofibers fabricated by an electrospinning alignment apparatus according to one embodiment of the present disclosure. All of the photographs in FIG. 8 and FIG. 9 show nanofibers with a relatively larger thickness (e.g., 100 nm to 340 nm) and nanofibers with a relatively smaller thickness (e.g., 60 to 100 nm). In a case where an air filter is manufactured using nanofibers with a small diameter, the size of pores in the air filter becomes smaller, thus increasing filter efficiency. However, the smaller pore size results in a deterioration of air filtration, thus lowering the overall filter performance. Such a filter performance may be quantified as quality factor, and may be expressed by QF=ln(1−efficiency %)/differential pressure (Pa). Thus, it is necessary to lower the differential pressure (air resistance). To this end, it is desirable that nanofibers with a small diameter are composed of multiple layers that are spaced apart from each other, with a proper space between them. Thus, nanofibers with a relatively larger thickness may act as an ideal spacer that widens distances between layers of non-woven nanofibers with a small diameter.

The first vertical direction in which nanofibers are spun may include an upward direction perpendicular to the first horizontal direction, and in some embodiments, a direction in which nanofibers are spun may be a downward direction.

The carrier transfer portion may transfer the carrier in a roll-to-roll manner while it is being unwound from a roll, and the carrier may include a non-woven fabric.

In one embodiment, the nanofibers spun from the plurality of first electrospinning portions and the nanofibers spun from the plurality of second electrospinning portions may include polyacrylonitrile. Also, in another embodiment, the nanofibers spun from the plurality of first electrospinning portions may include polyacrylonitrile, and the nanofibers spun from the plurality of second electrospinning portions may include PVDF-HFP (polyvinylidene fluoride-hexafluoropropylene). Other materials of the spun nanofibers may include one or a combination of two of the following: polymethylmethacrylate (PMMA), polyurethane, polysulfones (polysulfone, polyethersulfone, and polyphenylene sulfone), polyvinyl acetate (PVAc), polyacrylic acid (PAA), polyvinyl alcohol (PVA), polyvinylidene fluoride (PVDF)), polyimide (PI), polystyrene (PS), polycaprolactone (PCL), polylactic acid (PLA), poly(lactic-co-glycolic acid) (PLGA), and chitosan. A complex polymer produced by a combination of two or more types has the advantage of increasing thermal durability based on different molecular weights. If the thickness of the nanofibers spun from the first electrospinning portion is larger than the thickness of the nanofibers spun from the second electrospinning portion, the nanofibers are not limited to a specific polymer type.

The diameter of the nanofibers spun from the first electrospinning portion may range from 300 nm to 2,000 nm, and the diameter of the nanofibers spun from the second electrospinning portion may range from 10 nm to 300 nm.

Figure 10:
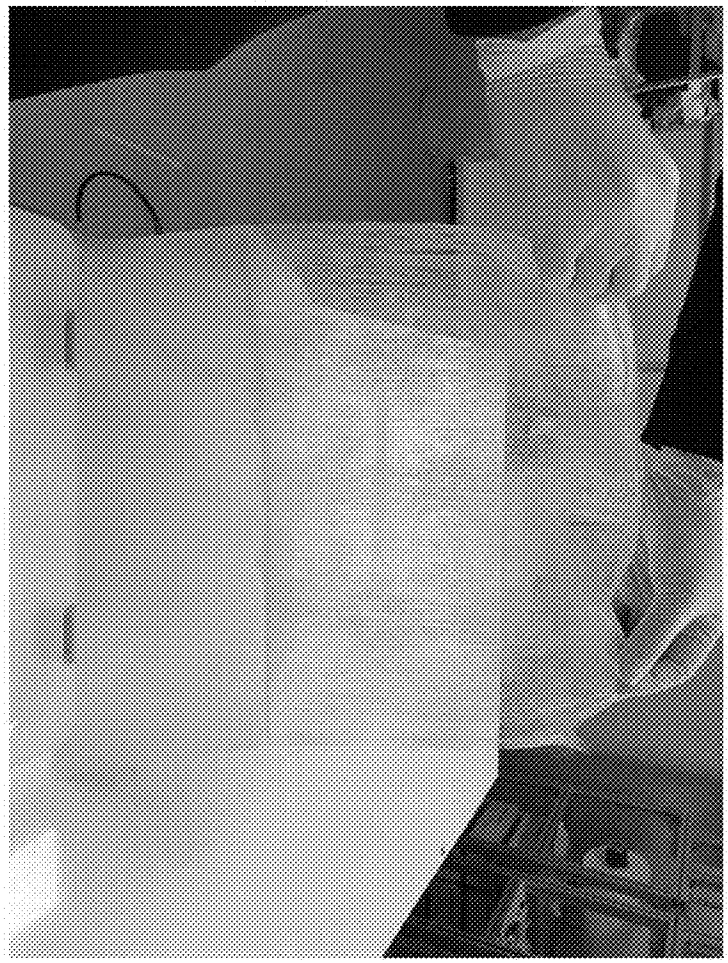
FIG. 10 is a photograph illustrating nanofiber membranes fabricated by an electrospinning alignment apparatus according to one embodiment of the present disclosure.

FIG. 10 is a photograph illustrating nanofiber membranes fabricated by an electrospinning alignment apparatus according to one embodiment of the present disclosure. The photograph of FIG. 10 shows one layer of nanofibers separated from a carrier. Since the layer contains nanofibers with a large diameter that are aligned in one direction, it has such durability that it can be handled with hands despite its small thickness of 10 μm or less.

Figure 11:
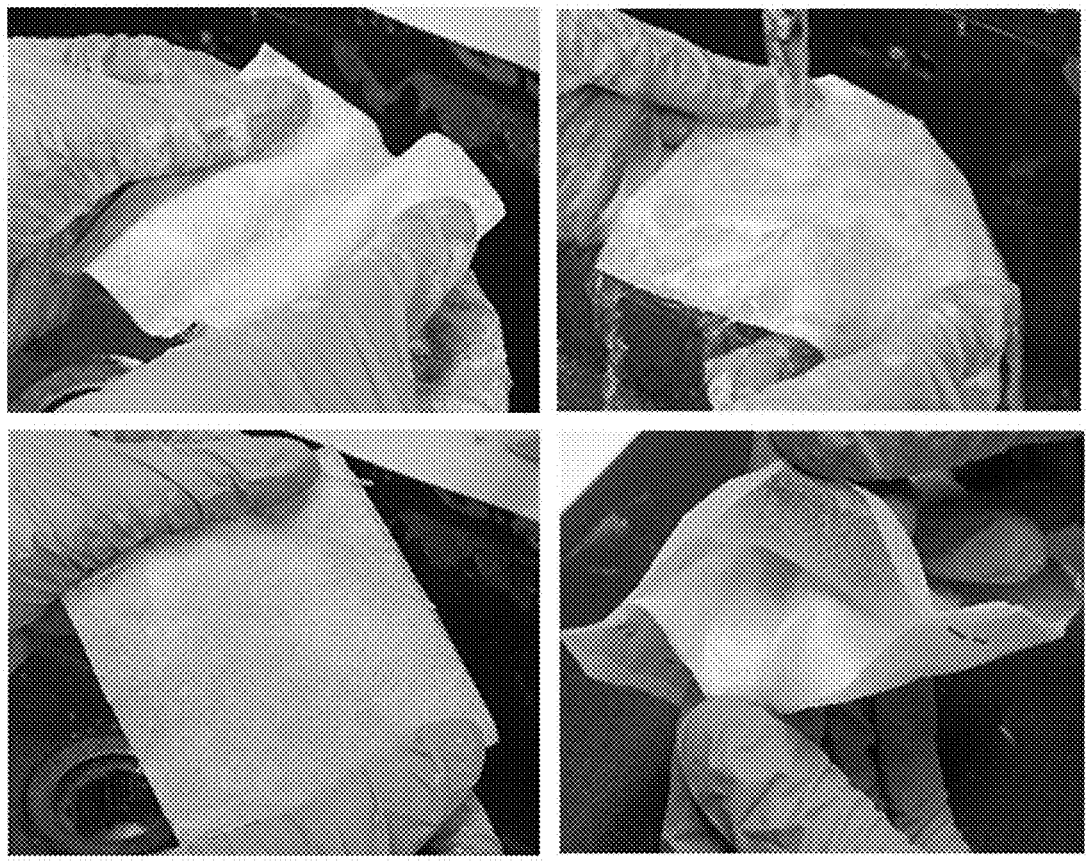
FIG. 11 is photographs of a washing stability test on a filter containing nanofiber membranes fabricated by an electrospinning alignment apparatus according to one embodiment of the present disclosure.

FIG. 11 is photographs of a washing stability test on a filter containing nanofiber membranes fabricated by an electrospinning alignment apparatus according to one embodiment of the present disclosure. The photographs of FIG. 11 are photographs of a washing stability test on a filter made of non-woven fabric, nanofibers, and nonwoven fabric stacked on one each other. A filter made using nanofiber membranes is washable since it uses physical blocking rather than an electrostatic method, and maintains a stable filtering effect even after washing. The photograph at the bottom right shows that a nanofiber filter is still attached between non-woven fabric filters.

Figure 12:
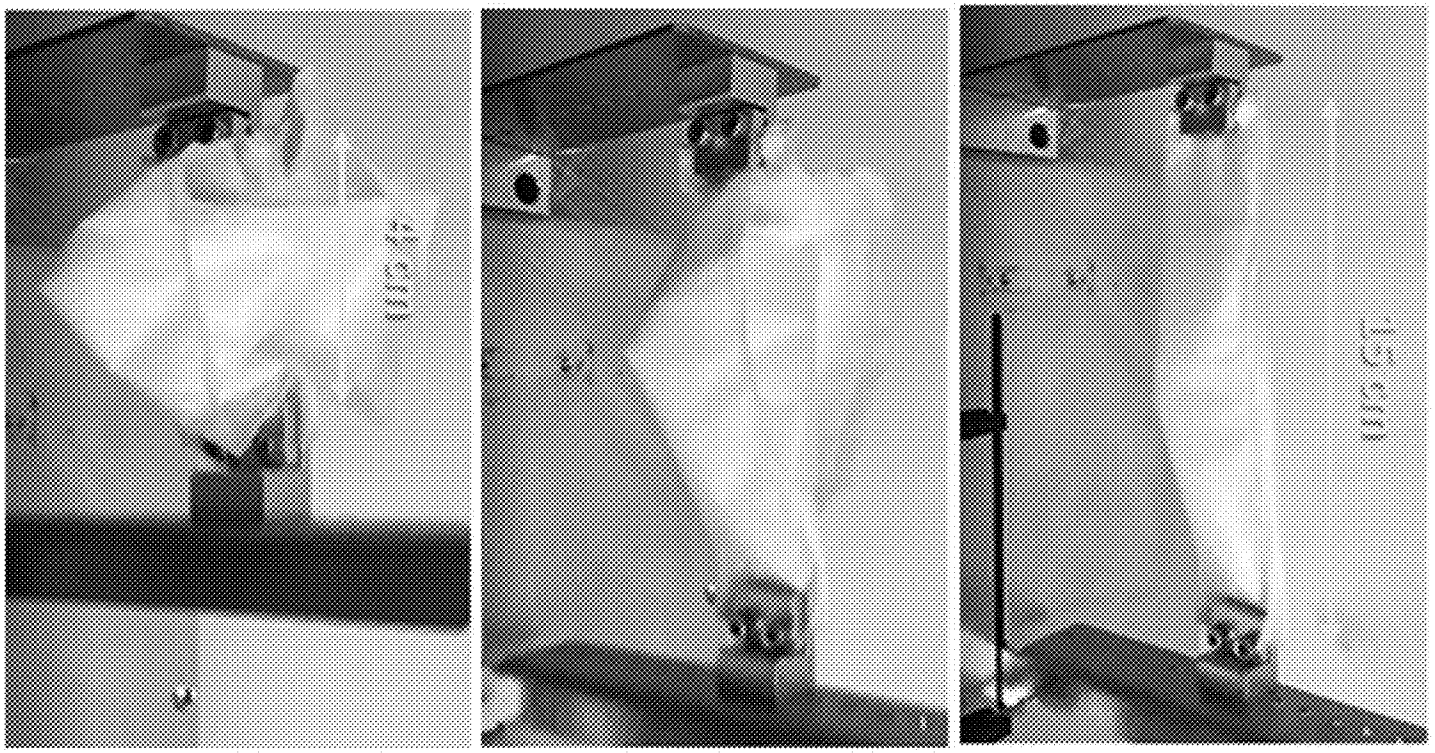
FIG. 12 is photographs showing an example of performing a repeated bending test on a filter containing nanofiber membranes fabricated by an electrospinning alignment apparatus according to one embodiment of the present disclosure.
Figure 13:
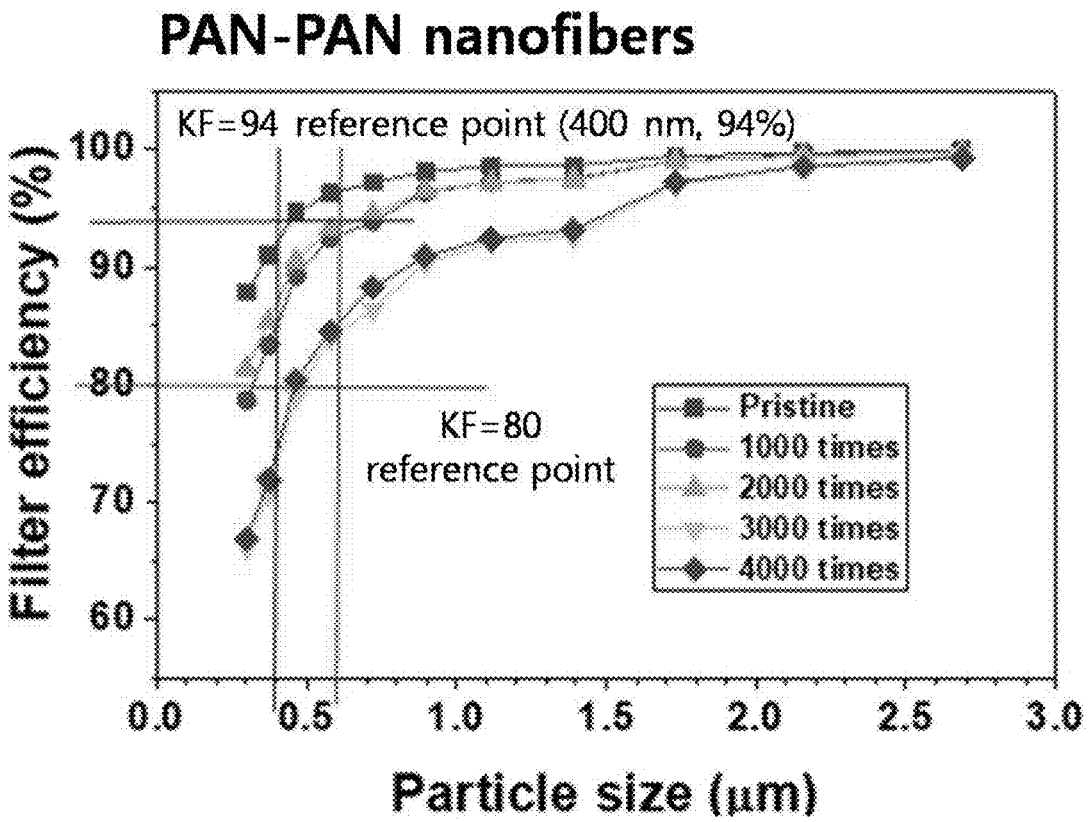
FIGS. 13 and 14 are graphs illustrating results of a washing stability test performed on a filter containing nanofiber membranes fabricated by an electrospinning alignment apparatus according to one embodiment of the present disclosure.
Figure 14:
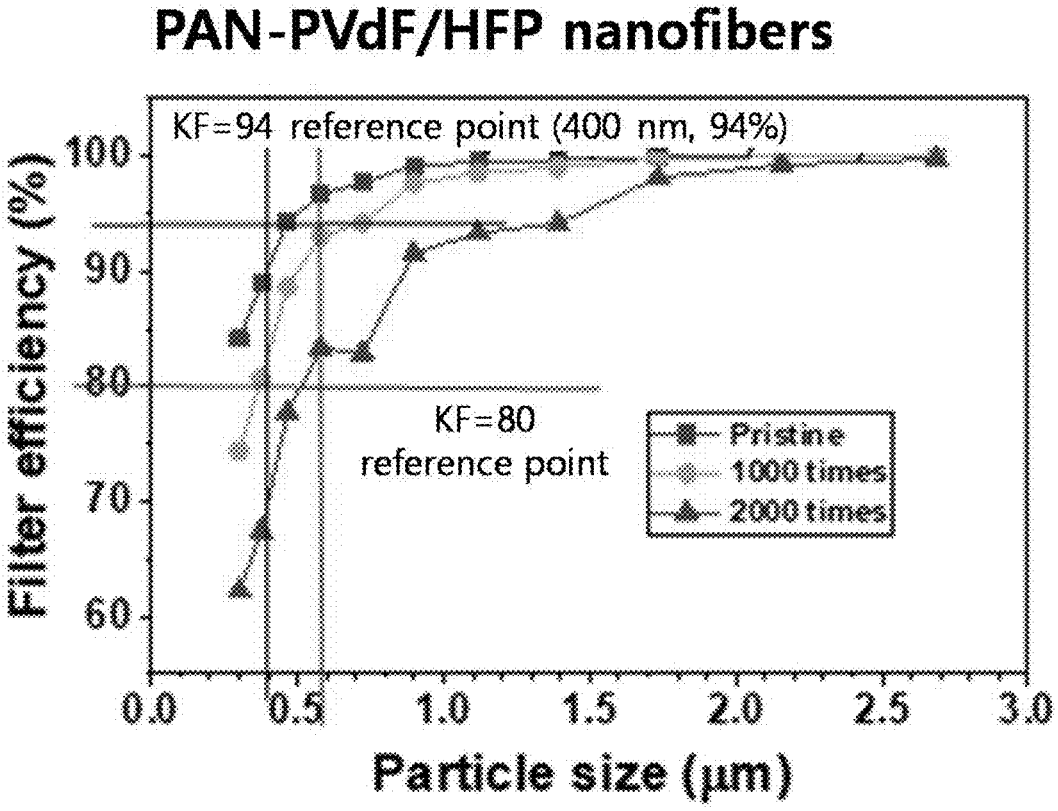

FIG. 12 is photographs showing an example of performing a repeated bending test on a filter containing nanofiber membranes fabricated by an electrospinning alignment apparatus according to one embodiment of the present disclosure. FIGS. 13 and 14 are graphs illustrating results of a washing stability test performed on a filter containing nanofiber membranes fabricated by an electrospinning alignment apparatus according to one embodiment of the present disclosure. FIG. 13 shows that PAN-PAN nanofibers are fabricated by using polyacrylonitrile as both the plurality of first electrospinning portions and the plurality of second electrospinning portions, FIG. 14 shows that PAN-PVDF/HFP nanofibers are fabricated by using polyacrylonitrile as the plurality of first electrospinning portions and PVDF-HFP (polyvinylidene fluoride—hexafluoropropylene) as the plurality of second electrospinning portions. In the graphs of FIGS. 13 and 14, "times" may mean the number of times a bending test was conducted, and "Particle size" may mean the size of particles used on a filter performance test. The graphs of FIGS. 13 and 14 show that the performance was decreased due to mechanical stress when the bending test was conducted up to 4,000, but still satisfied the level of KF80 (average particle size of 0.6 μm, filtration efficiency of 80% or higher).

In this way, according to the embodiments of the present disclosure, nanofiber membranes are mass-produced by simultaneously spinning nanofibers that are spun in alignment in one direction on a transferred carrier and nanofibers that are randomly spun.

The above-described system or apparatus may be implemented in the form of a hardware component or a combination of a hardware component and a software component. For example, the system and components described in the embodiments may be implemented using one or more general-purpose computers or special-purpose computers, such as a processor, a controller, an arithmetic logic unit (ALU), a digital signal processor, a microcomputer, a field programmable gate array (FPGA), a programmable logic unit (PLU), a microprocessor, or any other device capable of executing or responding to an instruction. A processing device may run an operating system (OS) and one or more software applications executed on the OS. Furthermore, the processing device may access, store, manipulate, process, and generate data in response to the execution of software. For convenience of understanding, one processing device has been illustrated as being used, but a person having ordinary skill in the art may understand that the processing device may include a plurality of processing elements and/or a plurality of types of processing elements. For example, the processing device may include a plurality of processors or a single processor and a single controller. Furthermore, a different processing configuration, such as a parallel processor, is also possible.

Software may include a computer program, code, an instruction, or a combination of one or more of these and may configure a processing device so that it operates as desired or may instruct the processing device independently or collectively. The software and/or data may be embodied in a machine, component, physical device, virtual equipment, computer storage medium or device of any type in order to be interpreted by the processing device or to provide an instruction or data to the processing device. The software may be distributed to computer systems connected over a network and may be stored or executed in a distributed manner. The software and data may be stored in one or more computer-readable recording media.

The method according to the embodiment may be implemented in the form of a program instruction executable by various computer means and stored in a computer-readable recording medium. The computer readable medium may include a program instruction, a data file, a data structure, or a combination thereof. The medium may continuously store a computer-executable program or may temporarily store the program for execution or download. Furthermore, the medium may be various recording means or storage means in the form of a single piece of hardware or a combination of several pieces of hardware. The medium is not limited to a medium directly connected to a computer system, but may be one distributed over a network. Examples of the medium include magnetic media such as a hard disk, a floppy disk and a magnetic tape, an optical recording medium such as CD-ROM and DVD, a magneto-optical medium such as a floptical disk, ROM, RAM, and flash memory, which are configured to store and execute program instructions. Also, other examples of the medium may include recording media and storage media managed by application stores distributing applications or by websites, servers, and the like supplying or distributing other various types of software

Mode for Disclosure

As described above, although the embodiments have been described in connection with the limited embodiments and the drawings, those skilled in the art may modify and change the embodiments in various ways from the description. For example, the relevant results may be achieved even when the described technologies are performed in a different order than the described methods, and/or even when the described components such as systems, structures, devices, and circuits are coupled or combined in a different form than the described methods or are replaced or substituted by other components or equivalents.

Therefore, other implementations, other embodiments, and equivalents to the claims are also within the scope of the following claims.

The invention claimed is:

1. An electrospinning alignment apparatus comprising:

a plurality of first electrospinning portions to which a first voltage is applied, for aligning and spinning nanofibers in a first horizontal direction, nanofibers spun from the plurality of first electrospinning portions being aligned in said first horizontal direction by a guide portion comprising guide bodies operative to change an electric field;

a plurality of second electrospinning portions to which the first voltage is applied, for randomly spinning the nanofibers, the nanofibers being spun from the plurality of second electrospinning portions in a random manner without being aligned by the guide bodies;

a stage portion to which a second voltage different than the first voltage is applied, spaced apart in a first vertical direction in which the nanofibers are spun from the plurality of first electrospinning portions and the plurality of second electrospinning portions; and a carrier transfer portion for coating the nanofibers spun from the plurality of first electrospinning portions and the plurality of second electrospinning portions onto a carrier by continuously passing the carrier between a position where the plurality of first electrospinning portions and the plurality of second electrospinning portions is disposed and a position where the stage portion is disposed, wherein the plurality of first electrospinning portions is spaced apart from each other in a second horizontal direction perpendicular to the first horizontal direction, wherein the guide bodies include a first guide body and a second guide body extending along the first horizontal direction and spaced apart from each other in the second horizontal direction to sandwich a corresponding one of the plurality of first electrospinning portions, and the first and second guide bodies are operative to change an electric field to align the nanofibers spun from said one of the plurality of first electrospinning portions in the first horizontal direction, and wherein the first guide body and the second guide body are individually made of a material with a relative dielectric constant of 50 or lower.

2. The electrospinning alignment apparatus of claim 1, wherein each of the plurality of first electrospinning portions includes a first spinning nozzle for spinning the nanofibers from a spinning solution.

3. The electrospinning alignment apparatus of claim 2, wherein the first spinning nozzle is disposed under a space between the first guide body and the second guide body.

4. The electrospinning alignment apparatus of claim 3, wherein at least one of the first and second guide bodies is shared with another one of the plurality of first electrospinning portions.

5. The electrospinning alignment apparatus of claim 1, wherein the plurality of second electrospinning portions is spaced apart from each other in the second horizontal direction perpendicular to the first horizontal direction, and each of the plurality of second electrospinning portions includes a second spinning nozzle for spinning the nanofibers from a spinning solution.

6. The electrospinning alignment apparatus of claim 1, wherein the plurality of first electrospinning portions each is disposed by forming m first columns (m is a natural number) including n first spinning nozzles (n is a natural number), and the plurality of second electrospinning portions each is disposed by forming i second columns (i is a natural number) including j second spinning nozzles (j is a natural number), wherein the m first columns and the i second columns are arranged in an alternating manner.

7. The electrospinning alignment apparatus of claim 6, wherein the n and the j are determined based on a width of the carrier in the second horizontal direction perpendicular to the first horizontal direction.

8. The electrospinning alignment apparatus of claim 6, wherein the production of nanofibers per unit of time is adjusted by adjusting the m, the i, and a transfer rate of the carrier.

9. The electrospinning alignment apparatus of claim 1, wherein a thickness of the nanofibers spun from the plurality of first electrospinning portions is relatively larger than a thickness of nanofibers spun from the plurality of second electrospinning portions.

10. The electrospinning alignment apparatus of claim 1, wherein a size of a space between the nanofibers coated onto the carrier is adjusted by adjusting a difference between a thickness of nanofibers spun from the plurality of first electrospinning portions and the thickness of nanofibers spun form the plurality of second electrospinning portions.

11. The electrospinning alignment apparatus of claim 1, wherein the first vertical direction in which the nanofibers are spun includes an upward direction perpendicular to the first horizontal direction.

12. The electrospinning alignment apparatus of claim 1, wherein the carrier transfer portion transfers the carrier in a roll-to-roll manner while it is being unwound from a roll.

13. The electrospinning alignment apparatus of claim 1, wherein the carrier includes a non-woven fabric.

14. The electrospinning alignment apparatus of claim 1, wherein the nanofibers spun from the plurality of first electrospinning portions and the nanofibers spun from the plurality of second electrospinning portions include one or a combination of two of the following: polyacrylonitrile, PVDF-HFP (polyvinylidene fluoride-hexafluoropropylene), polymethylmethacrylate (PMMA), polyurethane, polysulfones (polysulfone, polyethersulfone, and polyphenylene sulfone), polyvinyl acetate (PV Ac), polyacrylic acid (PAA), polyvinyl alcohol (PVA), polyvinylidene fluoride (PVDF), polyimide (PI), polystyrene (PS), polycaprolactone (PCL), poly lactic acid (PLA), poly(lactic-co-glycolic acid) (PLGA), and chitosan.

15. The electrospinning alignment apparatus of claim 1, wherein a diameter of the nanofibers spun from the plurality of first electrospinning portions ranges from 300 nm to 2,000 nm, and the diameter of the nanofibers spun from the second electrospinning portion ranges from 10 nm to 300 nm.

* * * * *